United States Patent [19]

Wilson et al.

[11] 4,159,036

[45] Jun. 26, 1979

[54] HIGH PRESSURE CLEANING AND PUMPING METHOD AND APPARATUS FOR OIL WELL PRODUCTION

[75] Inventors: Phillip M. Wilson, New Orleans, La.; Charles L. Presley, Houston, Tex.

[73] Assignee: Kobe, Inc., Huntington Park, Calif.

[21] Appl. No.: 913,839

[22] Filed: Jun. 8, 1978

[51] Int. Cl.[2] ..... E21B 43/00

[52] U.S. Cl. ..... 166/267; 166/68; 166/75 R; 166/105.5

[58] Field of Search ..... 166/265, 267, 62, 53, 166/68, 75 R, 105.4, 105.5, 105.6; 417/76–79

[56] References Cited

U.S. PATENT DOCUMENTS

| | | | |
|---|---|---|---|
| 3,071,189 | 1/1963 | Colvin et al. | 166/68 |
| 3,709,292 | 1/1973 | Palmour | 166/105.5 X |
| 3,759,324 | 9/1973 | Mecusker | 166/75 |
| 3,782,463 | 1/1974 | Palmour | 166/68 |
| 3,802,501 | 4/1974 | Mecusker | 166/75 |
| 3,970,143 | 7/1976 | Thrash | 166/53 |
| 3,982,589 | 9/1976 | Wilson et al. | 166/53 |

*Primary Examiner*—Stephen J. Novosad
*Attorney, Agent, or Firm*—Christie, Parker & Hale

[57] ABSTRACT

High pressure product fluid from a petroleum well goes into a high pressure separation vessel where preliminary phase separation of the constituents takes place. Oil and gas leave the preliminary separator by a flow line. Power fluid for a triplex pump flows from the high pressure separator into a separator tank that opens to atmosphere. Here, further separation of the phases takes place and power fluid low in abrasive solid content is taken off by a charging pump and fed to the triplex pump. The triplex pump increases the head of the power fluid and introduces it to the well. The power fluid may be either water or oil.

12 Claims, 1 Drawing Figure

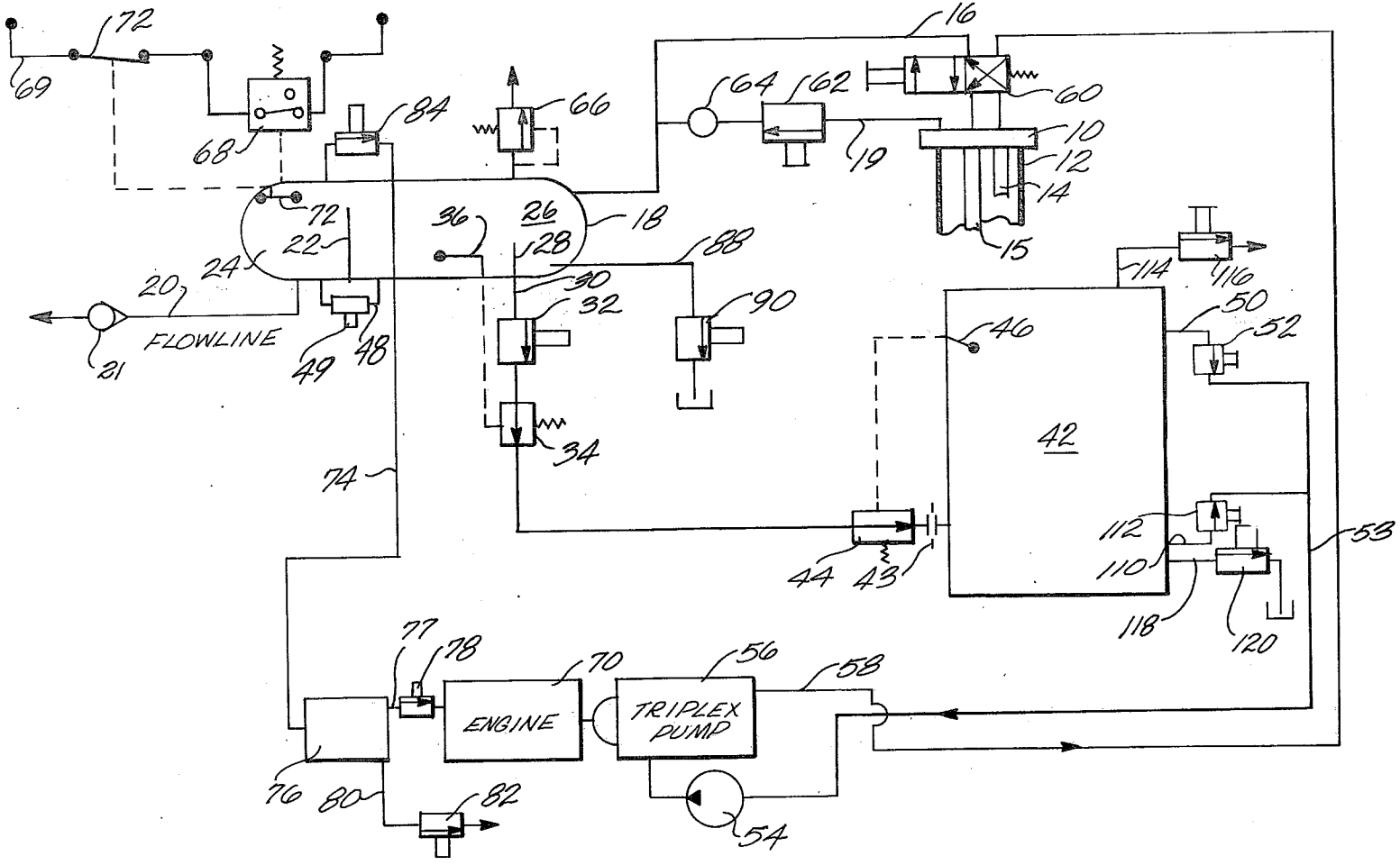
TRIPLEX PUMP
ENGINE
FLOWLINE

HIGH PRESSURE CLEANING AND PUMPING METHOD AND APPARATUS FOR OIL WELL PRODUCTION

BACKGROUND OF THE INVENTION

The present invention relates to the art of petroleum production in general, and, more in particular, to power fluid purification systems for a power fluid used downhole in a production well.

Petroleum wells quite often employ a power fluid. The fluid may operate a motor which in turn operates a downhole pump that provides sufficient head to raise petroleum values to the surface. In such a scheme, it has been convenient to use as a power fluid produced petroleum or produced water.

The effectiveness of the power fluid is directly related to the abrasives content. Small, solid particles in the power fluid can score and damage power fluid circuit machinery. For example, seals of a downhole pump motor can be lost, with a loss of effectiveness of the motor in producing the requisite power for a downhole pump to pump the petroleum. Also, damage to downhole machinery requires the lifting of the machinery from the well for repair or renewal. Clearly, both of these results are not satisfactory. In the first place, loss of the effectiveness of the motor shuts down the well. Second, it takes a considerable amount of time to raise and lower machinery and this time means loss of production. Moreover, it is expensive to lift and replace downhole machinery.

The power fluid mixes with production fluid in the petroleum recovery zone of the well and this admixture of production fluid in the power fluid is the source of the abrasives.

The art recognizes these problems and has proposed several approaches to maintain power fluid adequately free of abrasives.

One technique that has been used for cleaning power fluid employs one or more cyclone centrifugal separators. These separators, because of differences in density of the constituent parts of the fluid, separate out heavier particulates from lighter, purified liquid by centrifugal force. Examples of this technique are described in U.S. Pat. No. 3,709,292 to Palmour and U.S. Pat. No. 3,802,501 to Mecusker.

Cyclone separators are sensitive to the proportion of dirty fluid withdrawn from them. The flow rate to the cyclones and from the cyclones must be carefully controlled. There also must be a careful balance of the operating pressures that the cyclone experiences, namely the inlet and two outlet pressures. Differences in operating conditions can adversely affect the effectiveness of the cyclone. For example, differences in the proportion of the phases in the production fluid can result in an unacceptably high solid content in the stream from the cyclone for purified fluids.

One approach to avoiding the problem of the cyclone is disclosed in U.S. Pat. No. 3,982,589 to Wilson et al. This patent uses a separation vessel for the initial separation of the phases of the production fluid. A pitot pump and cleaner further purifies an effluent from the separation tank and produces power fluid for a multiplex pump that is used to raise the head of the power fluid.

In some well applications the production fluid is at a high pressure and it is undesirable to lose this pressure. The pressure can be used, for example, to force product fluid from the production fluid through surface lines.

The use of settling tanks, however, to produce power fluid of adequate purity in a pressurized environment is not practical because the cost of the pressure vessel becomes too high.

It is desirable, then, to have a production fluid purification system that enables the separation of solids from production fluid while maintaining the pressure head of the production fluid so that the head may be used to force product fluid through surface lines. In addition, in such a system, it is desirable to form a separate stream of power fluid. This facility should avoid the problems attendant with cyclone separation.

SUMMARY OF THE INVENTION

The present invention provides in a system for cleaning production fluid to form a power fluid, a high pressure separation tank that separates production fluid on a gross basis into its phases under production fluid pressure and produces a stream that forms the power fluid and a high pressure product stream. An example of a typical pressure is 600 p.s.i. A second low pressure settling tank or pressure vessel receives grossly cleansed power fluid, and through gravity, final separation occurs. This second tank operates at low pressure, say atmospheric, and may have a larger capacity than the first tank. Purified power fluid is taken from the low pressure separation tank as the feed to a high pressure surface pump that increases the head of the power fluid and forces it down a petroleum well.

A specific form of the present invention contemplates a pressure vessel in series with the production fluid of a petroleum well and rated at the discharge pressure of the production fluid. The vessel has a means for grossly separating the phases of the production fluid. Typically, production fluid separation will include separation of some solids, some gas, and some oil. Sometimes water will be produced and it is a separate phase. The gas is taken off the ullage space of the vessel and may be used to power a prime mover of the power fluid pump. The fluid which has become the power fluid, and this fluid may be either oil or water, is taken from the pressure vessel and discharged into a settling vessel that is open to atmosphere. The settling vessel is sufficiently large to effect separation of solids from the fluid to form cleansed power fluid. As is known, this criteria is met when the settling rate of the solids exceeds the maximum vertical drawdown rate of the vessel, the influent to the vessel is introduced towards the bottom of the vessel, and the effluent from the vessel is taken at a point elevated above the influent point. Pressure reduction means between the high and low pressure vessels prevents dissipation of pressure head in the low pressure vessel and therefore undesired rolling of the fluid there. The pressure reduction means can be an orifice. The discharge from the settling tank forms the feed for the power pump, say a multiplex pump. Any required feed head can be supplied by a charging pump in series between the power pump and the settling vessel. The power pump is run by an engine, preferably powered by gas from the ullage space of the pressure vessel. The discharge from the power pump is into the well and forms the working fluid for downhole machinery, such as a double acting pump.

These and other features, aspects and advantages of the present invention will become more apparent from the following description, appended claims, and drawing.

BRIEF DESCRIPTION OF THE FIGURE

The single FIGURE is a line schematic of the system of the present invention.

DESCRIPTION OF THE PREFERRED EMBODIMENT

With reference to the single FIGURE, a well head 10 caps a casing 12. The casing contains a large tubing string 14 and a small tubing string 15. Power fluid passes down through the large tubing string into the well to operate machinery down in the well. For example, the power fluid can operate a hydraulic pump. Production fluid including spent power fluid rises in small tubing string 15. Free gas rises from the production zone between the casing and the tubing strings. Product fluid and spent power fluid pass out of the well through a line 16 and into a high pressure, gross separation vessel 18. Free gas passes out from the well through a line 19 and it also goes into the high pressure, gross separation vessel 18.

Vessel 18 is maintained at the pressure of the production fluid, say 600 p.s.i. This enables discharge from the pressure vessel to retain this head. Product fluid discharges from the vessel in a product flow line 20. A check valve 21 in line 20 prevents backflow from the line into vessel 18.

In vessel 18, production fluid grossly separates into its phases. The phases are at least solids and oil, and can be solids, water, oil and gas. After gross separation, product oil, gas and water leave vessel 18 in line 20. The fluid in pressure vessel 18 is dammed behind a weir 22 and overflows into a compartment 24 for discharge of oil and any water out line 20. Separated gas phase also leaves vessel 18 in line 20. The weir separates the vessel into compartments 24 and 26. The fluid overflowing the weir into compartment 24 is the product oil and any water that leaves in line 20. The liquid behind weir 22 in a compartment 26 separates into oil, water and solids but with water present the compartment will fill with water. Compartment 26 opens directly into line 16 and the production fluid. Weir 22 keeps production fluid solids from entering compartment 24. If the production fluid contains any water cut, water will go over the weir into compartment 24. Separation vessel 18, then, effects separation in advance of product flow line 20 without controls and control valves and maintains a high head for product oil, gas and water. The weir assures adequate liquid fluid in compartment 26, within normal operating excursions, to prevent gas phase production fluid from leaving vessel 18 through the lines leaving compartment 26. The separation that occurs in the vessel is not complete and further removal of solid is required.

A stand pipe 28 extends into compartment 26 to a limit well below the top of the weir. The stand pipe communicates with a line 30. A hand valve 32 in the line allows power fluid to flow through it under the pressure of the production fluid. A flow control valve 34 in line 30 responds to a low level float control 36 to stop flow through line 30 when the level of liquid in vessel 18 gets too low. Line 30 extends from valve 34 into the bottom of a settling tank 42. A pressure reducing orifice 43 in line 30 reduces the pressure in the line from that existing in the high pressure tank to slightly above atmospheric, assuming no substantial pressure loss upstream of the orifice. The dissipation of excessive head by the orifice assures that the fluid in tank 42 will not roll. The rolling of the fluid can prevent solids from settling out of suspension from the fluid. Of course, other means to reduce the pressure of fluid in line 30 can be used including a restricted line or even tank 42 if rolling is not a problem. A valve 44 in line 30 is controlled by a float switch 46. When the level of fluid in tank 42 is too high, float switch 46 closes valve 44 and the tank can no longer receive power fluid. The flow rate of production fluid into compartment 26 is greater than the flow rate of power fluid out of the compartment in line 30. This is the reason that with water in the production fluid, compartment 36 fills with water to the exclusion of oil. When no water is in the production fluid, compartment 26 is filled with oil.

A bipass line 48 between compartments 24 and 26 has a valve 49 that is normally closed. This line and valve allow the selective communication of the compartments. The valve is normally closed to permit liquid to accumulate in compartment 26 and to thereby prevent gas from passing through line 30.

In separation tank 42, fine separation of solids from the fluid which is to be the power fluid takes place. As is known, separation is accomplished when the settling rate of solids exceeds the vertical drawdown rate of the tank and the tank is comparatively quiescent so as to avoid mixing of separated solid with liquid. Settling tank 42 opens to atmosphere. Accordingly the settling tank need be made to withstand only the weight of the fluid it contains and not, in addition, superatmospheric pressures.

Fluid separates into phases in separation tank 42 by gravity. Power fluid, whether water or oil, will be at the bottom, and gas at the top. Any gas normally results from gas coming out of solution in tank 42 because of the low pressure there compared with production pressure. Power fluid, say oil, is normally taken off of tank 42 through a line 50. A valve 52 in line 50 controls the flow of fluid through the line. Line 48 joins a line 53 that supplies the feed to a charging pump 54 for a multiplex pump, here a triplex pump 56. Power fluid fed to the triplex pump has its head increased by the pump and leaves the pump in a line 58. This power fluid is the power fluid that operates downhole machinery. The power fluid in line 58 is introduced to this downhole machinery through pipe string 14.

A four-way valve 60 in line 58 controls the flow of power fluid through it. Four-way valve 60 is also plumbed in line 16 to control the flow of fluid through it. In one position of the valve, the valve directs power fluid down large tubing string 14 and passes production fluid and spent power fluid up through small tubing string 15. The other setting of valve 60 directs power fluid down small string 15 and exits this fluid through large tubing string 14. The latter direction of circulation raises downhole machinery for renewal or maintenance.

Free gas coming out of the well in the annulus between the tubing string and the casing leaves through line 19. A valve 62 in that line controls the flow of fluid through it. A check valve 64 in the line prevents backflow in a direction towards the well.

Gross separation vessel 18 has a normally closed relief valve 66 to vent pressure in it in the event that the pressure becomes too high.

Additionally, a pressure switch 68 sensing an excessive pressure within the ullage space of the high pressure separation vessel operates to interrupt an ignition circuit 69 of an engine 70 that operates the triplex pump. An excess level switch 72 of vessel 18 also in the ignition circuit controls engine 70 so that when the level within the vessel becomes too high the engine stops. The effect of cutting off the engine for the triplex pump is to prevent the pumping of fluid into separation vessel 18 until such time that the fluid in that vessel is drawn down or the pressure has been reduced, or both, as sensed by the safety switches 68 and 72.

A gas line 74 from the ullage space of separation vessel 18 feeds a scrubber 76 where gas is purified prior to being supplied as fuel to engine 70. The engine fuel supply is through a line 77 between the scrubber and the intake manifold of the engine. The pressure of the gas in line 74 being comparatively high can provide a supercharge to the engine by driving a turbine that in turn drives a compressor to compress combustion air and combining with the compressed combustion air downstream from the compressor. Alternatively, a pressure reducer in line 74 can be used. A valve 78 in line 77 controls the flow of gas through it. Excess gas is drawn off scrubber 76 through a line 80. A valve 82 in line 80 controls the flow of gas through it. A valve 84 in line 74 controls the flow of gas through that line. A blowdown line 88 from vessel 18 provides a way of getting rid of accumulated solids in the rough separation vessel. A normally closed valve 90 in line 88 controls flow through it.

What has been described thus far has been directed to a separation system of a gross separation vessel that operates under well discharge pressure that is comparatively high. In addition, a second separation vessel, in the form of a tank typically operating at atmospheric pressure, completes the separation process and permits the use of cleansed production fluid as the power fluid for downwell purposes. The power fluid described has been either oil or water. When the production fluid contains oil and water, water is the power fluid and compartment 26 contains only water with a thin film of oil on it, the production fluid oil having left compartment 26 over weir 22.

In the event that separation tank 42 has too low a level of power fluid, the fluid is drawn off at a lower level. A line 110 from vessel 42 to line 53 has an entrance in the vessel at a low level in the vessel. The level is above the level of solid accumulation. A valve 112 in line 100 controls the flow of power fluid through the line. In the event of a low level of power fluid, valve 112 is opened to establish power fluid flow through line 110. This low level draw is not normally used.

Gas separated from separation tank 42 is drawn off through a line 114, the flow through which is controlled by a valve 116. A line 118 to a drain enables the cleaning out of tank 42. The flow through line 118 is controlled by a valve 120.

The present invention has been described with reference to a preferred embodiment. The spirit and scope of the appended claims should not, however, necessarily be limited to the foregoing description.

What is claimed is:

1. In a system for cleaning production fluid from a petroleum well of solids to form a power fluid stream for the operation of machinery in the well and a product fluid stream, and wherein the production fluid from the well is at a high pressure, an improvement which comprises:

(a) a closed, high pressure separation vessel in communication with the production fluid of the well for rough separation of the production fluid into its phases at a high pressure supplied by the production fluid;

(b) means for drawing at least one roughly separated liquid phase from the high pressure separation vessel for ultimately forming the power fluid;

(c) a second, low pressure separation vessel in communication with the drawing means to receive the drawn phase, the low pressure separation vessel being operable at a pressure lower than the pressure in the high pressure separation vessel to further clean the fluid therein by gravity separation;

(d) means to reduce the pressure of the drawn phases to substantially the operation pressure in the low pressure separation vessel;

(e) means for drawing cleansed fluid from the low pressure separation vessel as the power fluid for the well;

(f) means to introduce the power fluid into the well; and (g) means for drawing a product stream of at least one of the separated phases in the high pressure separation vessel from such vessel at the high pressure in the high pressure separation vessel.

2. The improvement claimed in claim 1 including means to maintain the second separation vessel at about one atmosphere pressure.

3. The improvement claimed in claim 2 wherein the drawing means for the separated phase that ultimately forms the power fluid includes a line between the high pressure vessel and the low pressure separation vessel and valve means in this line to control the flow of fluid through it, and the pressure reducing means is in this line.

4. In a system for cleansing production fluid from a petroleum well of solids to form a power fluid for the operation of downhole machinery in the well and wherein the production fluid from the well is at a high pressure, an improvement which comprises:

(a) a closed, high pressure separation vessel in communication with the production fluid of the well for the gross separation of the production fluid into its phases, including at least one liquid phase at a high pressure provided by the production fluid;

(b) a low pressure separation tank for receiving the separated liquid phase from the high pressure separation vessel and to further cause phase separation of the received fluid by gravity separation of solids from the liquid to generate cleansed power fluid;

(c) means to maintain a low pressure in the low pressure separation tank, such low pressure being lower than the high pressure in the high pressure separation vessel;

(d) means for communicating the high pressure separation vessel with the low pressure separation tank to supply the latter with the separated liquid phase from the former;

(e) means for reducing the pressure of the separated liquid phase entering the low pressure separation tank upstream of such tank to prevent rolling of the liquid in the tank which would otherwise occur because of an excessive pressure head of the entering liquid phase;

(f) means for drawing the cleansed liquid from the low pressure separation tank as the power fluid;

(g) means to introduce the power fluid into the well under pressure; and (h) means for drawing off from the high pressure separation vessel a product fluid constituted from at least one of the separated phases in such vessel at the high pressure in the high pressure separation vessel.

5. The improvement claimed in claim 4 wherein the high pressure separation vessel includes a weir that separates such vessel into a first and a second compartment, the first compartment being in direct communication with the production fluid and the communication means between the high pressure separation vessel and the low pressure separation tank, the weir being operable to pass from the first compartment to the second compartment the product fluid, and the means for drawing off from the high pressure separation vessel the product fluid opens directly into the second compartment.

6. The improvement claimed in claim 5 wherein the means to maintain a low pressure in the low pressure separation tank is operable to maintain the low pressure at about atmospheric pressure.

7. The improvement claimed in claim 6 wherein the communication means between the high pressure separation vessel and the low pressure separation tank includes a line between the high pressure separation vessel and the tank, a valve in the line to control flow of liquid therethrough, and the pressure reducing means is in the line.

8. The improvement claimed in claim 7 including engine means of the introduction means to provide pressurizing energy to the power fluid and means to supply the engine with gas from the high pressure separation vessel as a fuel for the engine.

9. The improvement claimed in claim 8 including:

(a) switch means in the high pressure separation vessel to sense an excessive pressure therein and means responsive to the switch means to stop the introduction means; and (b) high liquid level sensing switch means in the high pressure separation vessel to stop the introduction means at a predetermined high liquid level in the high pressure separation vessel.

10. In a petroleum production process from a petroleum well with a high pressure production fluid comprising the steps of:

(a) passing high pressure production fluid into a closed separation vessel;

(b) maintaining the pressure in the closed separation vessel at a high level by the high pressure production fluid;

(c) separating production fluid into phases in the separation vessel;

(d) drawing off at least one liquid phase from the separation vessel and introducing such drawn off liquid into a settling tank;

(e) maintaining any gas pressure in the settling tank at a level substantially lower than in the separation vessel;

(f) separating the fluid in the settling tank into phases and settling out solid materials;

(g) drawing production power fluid from the settling tank and introducing it into a pressurizing pump;

(h) increasing the pressure head of the power fluid by the pressurizing pump and introducing the pressurized power fluid into the petroleum well; and (i) drawing product fluid constituted from at least one of the separated phases in the separation vessel from the separation vessel at substantially the high pressure therein.

11. The process claimed in claim 10 including reducing the pressure of the fluid passing between the closed pressure vessel and the settling tank to about the pressure in the settling tank externally of both the settling tank and the closed pressure vessel so as to prevent rolling of fluid in the settling tank.

12. The process claimed in claim 11 including the drawing off of gas from the closed separation vessel and using that gas as an energy source in the pressurization of the power fluid.

* * * * *